US007131518B2

(12) United States Patent
Weiss

(10) Patent No.: US 7,131,518 B2
(45) Date of Patent: Nov. 7, 2006

(54) MOTION CONTROL APPARATUS WITH BACKLASH REDUCTION

(75) Inventor: Kevin B. Weiss, Stillwater, MN (US)

(73) Assignee: Nexen Group, Inc., Vadnais Heights, MN (US)

( * ) Notice: Subject to any disclaimer, the term of this patent is extended or adjusted under 35 U.S.C. 154(b) by 0 days.

(21) Appl. No.: 10/714,279

(22) Filed: Nov. 14, 2003

(65) Prior Publication Data

US 2005/0103578 A1 May 19, 2005

(51) Int. Cl.
*B65H 59/10* (2006.01)

(52) U.S. Cl. ..... 188/67; 188/170; 188/265

(58) Field of Classification Search ..... 188/67, 188/170, 265; 92/24–28, 18; 91/41–45; 16/DIG. 17

See application file for complete search history.

(56) References Cited

U.S. PATENT DOCUMENTS

| | | | | |
|---|---|---|---|---|
| 3,203,513 A | | 8/1965 | Allen | 188/170 |
| 4,185,539 A | * | 1/1980 | Stratienko | 188/67 |
| 4,577,732 A | | 3/1986 | Gottling | 188/67 |
| 4,910,846 A | * | 3/1990 | Andreasson et al. | 29/898.061 |
| 5,115,889 A | | 5/1992 | Fortmann et al. | 188/67 |
| 5,197,573 A | * | 3/1993 | De La Fuente et al. | 188/67 |
| 5,540,135 A | | 7/1996 | Goellner | 91/41 |
| 5,791,230 A | | 8/1998 | Goellner | 92/19 |
| 5,979,267 A | | 11/1999 | Yonezawa | 74/531 |
| 6,152,268 A | | 11/2000 | Goellner et al. | 188/67 |
| 6,178,870 B1 | * | 1/2001 | Takahashi | 92/17 |
| 6,412,606 B1 | * | 7/2002 | Wu | 188/68 |
| 6,612,221 B1 | * | 9/2003 | Rollgrdh | 92/21 MR |

FOREIGN PATENT DOCUMENTS

| | | |
|---|---|---|
| DE | 3615985 | 11/1987 |

* cited by examiner

*Primary Examiner*—Thomas Williams
(74) *Attorney, Agent, or Firm*—Alan D. Kamrath; Nikolai & Mersereau, P.A.

(57) ABSTRACT

A motion controller for use with a rod (10A, 10B, 10C) has a backlash reducer (88A, 88B, 88C) that substantially reduces or eliminates the space created after manufacturing parts with specified tolerance dimensions to substantially reduce or eliminate backlash. The backlash reducer (88A, 88B) can be in the form of a holder such as an internal retaining ring (78) and a shim (36), a threaded cap (38), or the like to accommodate various part size variances due to manufacturing tolerances. Alternately, the end cap (45) of the motion controller (10C) can have an outside thread (41) that mates to an inside thread (43) of the inside surface (54) of a housing (29). The motion controller (10A, 10B, 10C) has a friction collar (12) to hold the rod (14) under the action of balls (16) and a piston (18). The motion controller (10A, 10B, 10C) can be fluid powered with a fluid such as air.

15 Claims, 5 Drawing Sheets

MOTION CONTROL APPARATUS WITH BACKLASH REDUCTION

BACKGROUND

This invention generally relates to an apparatus for reducing backlash in a rod motion controller, and more particularly to an apparatus that uses a backlash reducer to substantially reduce or eliminate backlash in the rod motion controller.

Many structural and mechanical applications require the use of moving rods and linkages that need to be secured in different modes, including fail-safe modes. For example, overhead doors on airframes that are actuated by rods driven by pneumatic pressure should be fitted with a device that will prevent accidental closure of the door in case of pneumatic pressure failure. Other applications require that rod or linkage position be maintained after positioning. One good solution to these problems is a rod retaining mechanism such as a rod motion controller.

Rod retaining mechanisms restrain relative motion between the rod and the rod retaining mechanism. By connecting the rod retaining mechanism to a mount, the rod may be retained and its motion thereby arrested with respect to the mount. Rod retaining mechanisms are typically manufactured with specified manufacturing tolerances. Because typically more than one part cooperates in a rod retaining mechanism to achieve the desired results, the net effect is to magnify any operational deficiencies due to specified manufacturing tolerances. One type of operational deficiency caused by specified manufacturing tolerances in prior art rod retaining mechanisms is backlash. Backlash is the undesirable movement of the rod after engagement of the rod retaining mechanism. Backlash is due to the internal design of the rod retaining mechanism and arises from the internal movement of restraining devices as they actuate to grab the rod and as they actuate to stop or lock the rod. While using high tolerance parts in the rod retaining mechanism could potentially reduce backlash, high tolerance parts are expensive, impractical, or may be impossible to produce due to material and manufacturing limitations and may not always result in an acceptable level of backlash reduction. When the force on the rod changes magnitude or direction, any backlash in the rod retaining mechanism will result in motion of the rod in an undesirable direction.

Therefore, it is the motivation of the invention to provide a novel motion control apparatus for use with a rod with reliable reduction in backlash.

SUMMARY OF THE INVENTION

The present invention solves these needs and other problems in the field of rod motion controllers by providing, in the preferred form, an apparatus for motion control of a rod. The rod has an axis defining an axial direction and is shiftable in the axial direction. The apparatus for motion control of a rod has a housing, having an inside housing surface, forming a hole to receive the rod there through along the axial direction. A piston mounted in the inside housing surface of the housing is moveable between a rod motion controller engaged position and a rod motion controller unengaged position. An end cap is slideably mounted on the inside surface of the housing to allow motion of the end cap in the axial direction. A friction collar is mounted between the housing and the end cap, with an engaging force being generated by the friction collar when the piston is moved to the rod motion controller engaged position. In the rod motion controller engaged position, the rod's motion is slowed or stopped (locked) in the axial direction. In the rod motion controller unengaged position, the rod is shiftable in the axial direction. A backlash reducer reduces relative motion in the axial direction between the friction collar and the housing and between the friction collar and the end cap when the piston is in the rod motion controller engaged position and when the piston is in the rod motion controller unengaged position to reduce backlash in the axial direction when the piston is in the rod motion controller engaged position.

The invention further provides in the preferred aspects that the backlash reducer is a holder to reduce backlash by reducing relative motion in the axial direction between the friction collar and the housing and between the friction collar and the end cap.

The invention further provides in the preferred aspects that the holder has an internal retaining ring mounted on the inside surface of the housing and that the end cap has a first end in contact with the friction collar and a second end held by the internal retaining ring in a backlash reducing position to reduce backlash by reducing relative motion in the axial direction between the friction collar and the housing and between the friction collar and the end cap.

The invention further provides in the preferred aspects that the holder is a threaded cap having outside thread. The inside surface of the housing has inside thread, with the outside thread mating with the inside thread to reduce backlash by reducing relative motion along the axial direction between the friction collar and the housing and between the friction collar and the end cap.

The invention further provides in the preferred aspects that the friction collar has a plurality of tracks to support a plurality of balls. The balls are positioned between the plurality of tracks and the piston. The friction collar has a plurality of slits in a first direction and a plurality of slits in a second direction. The first direction opposes the second direction, and the plurality of slits in the first direction and the plurality of slits in the second direction provide for ease of deflection of the friction collar.

The invention further provides in the preferred aspects that the holder is an internal retaining ring and a backlash reducing shim and provides in the preferred aspects that the end cap has a first end in contact with the friction collar and a second end in contact with the backlash reducing shim. Also, the internal retaining ring is mounted on the inside housing surface of the housing with the backlash reducing shim, with the shim positioned in contact with the internal retaining ring.

The invention further provides in the preferred aspects that the backlash reducer is integrally formed with the members that cooperate to restrain relative motion of the friction collar.

The invention further provides in the preferred aspects members integrally formed as an outside thread on the end cap and an inside thread on the inside surface of the housing, with the outside thread mating with the inside thread to reduce backlash by reducing relative motion in the axial direction between the friction collar and the housing and between the friction collar and the end cap.

The invention further provides applying a force to the end cap to eliminate any space between the end cap, the friction collar and the housing and holding the relative position of the end cap, the friction collar and the housing to reduce backlash in operation.

The invention further provides measuring a space from the end cap to the position of the internal retaining ring when the friction collar is pressed against the housing as the end cap is pressed against the friction collar to remove space, and provides a backlash reducing shim that has a width that is equal to or less than the measured space and installing the backlash reducing shim and the internal retaining ring so that the backlash reducing shim takes up the space between the internal retaining ring and the end cap.

The invention further provides manufacturing an inside thread on the housing and an outside thread on the end cap and screwing the end cap by the outside thread into the inside thread to hold the relative positions of the end cap, the friction collar and the housing.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
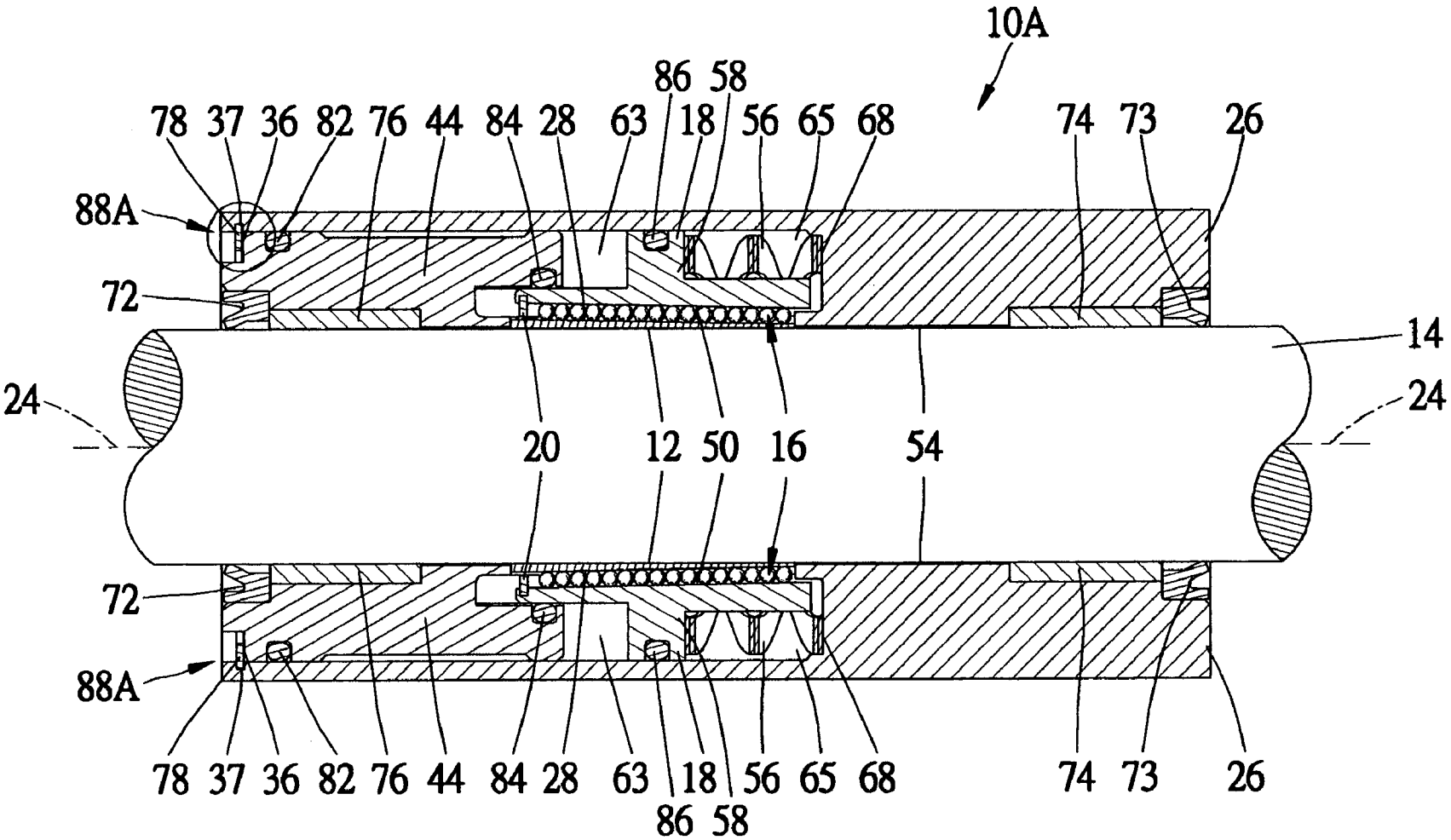
FIG. 1 is a cross sectional view of a rod motion controller according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following description has been read and understood. Further, the exact dimensions and dimensional proportions to conform to specific force, pressure, weight, strength, proportions, ratios and similar requirements will likewise be within the skill of the art after the following description has been read and understood.

Where used in the various figures of the drawings, the same numerals designate the same or similar parts. Furthermore, when the terms "side," "end," "top," "bottom," "first," "second," "laterally," "longitudinally," "row," "column," and similar terms are used herein, it should be understood that these terms have reference only to the structure shown in the drawings as it would appear to a person viewing the drawings and are utilized only to facilitate describing the illustrative embodiments.

DESCRIPTION OF THE PREFERRED EMBODIMENTS

Figure 2:
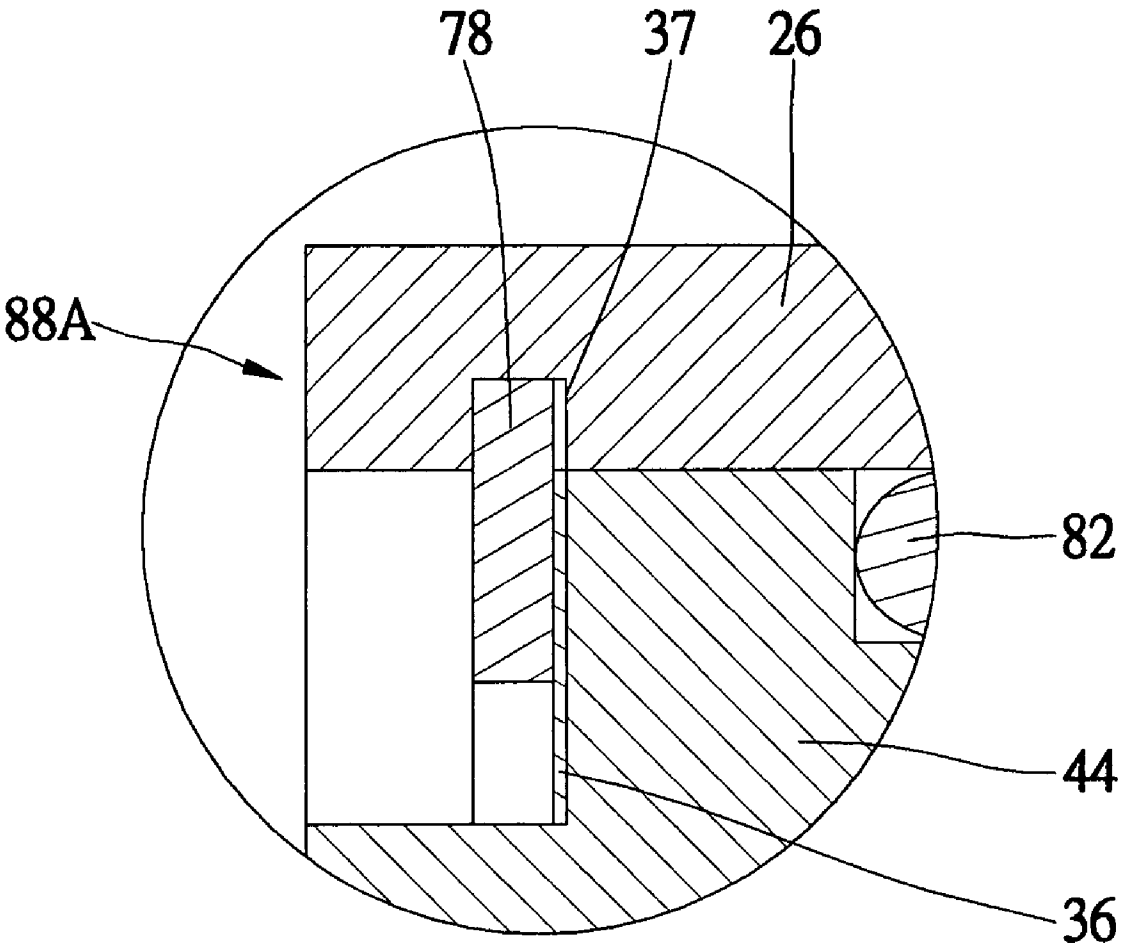
FIG. 2 is an enlarged view of a cross section of a backlash reducer of the rod motion controller according to the preferred teachings of the present invention shown in FIG. 1.
Figure 3:
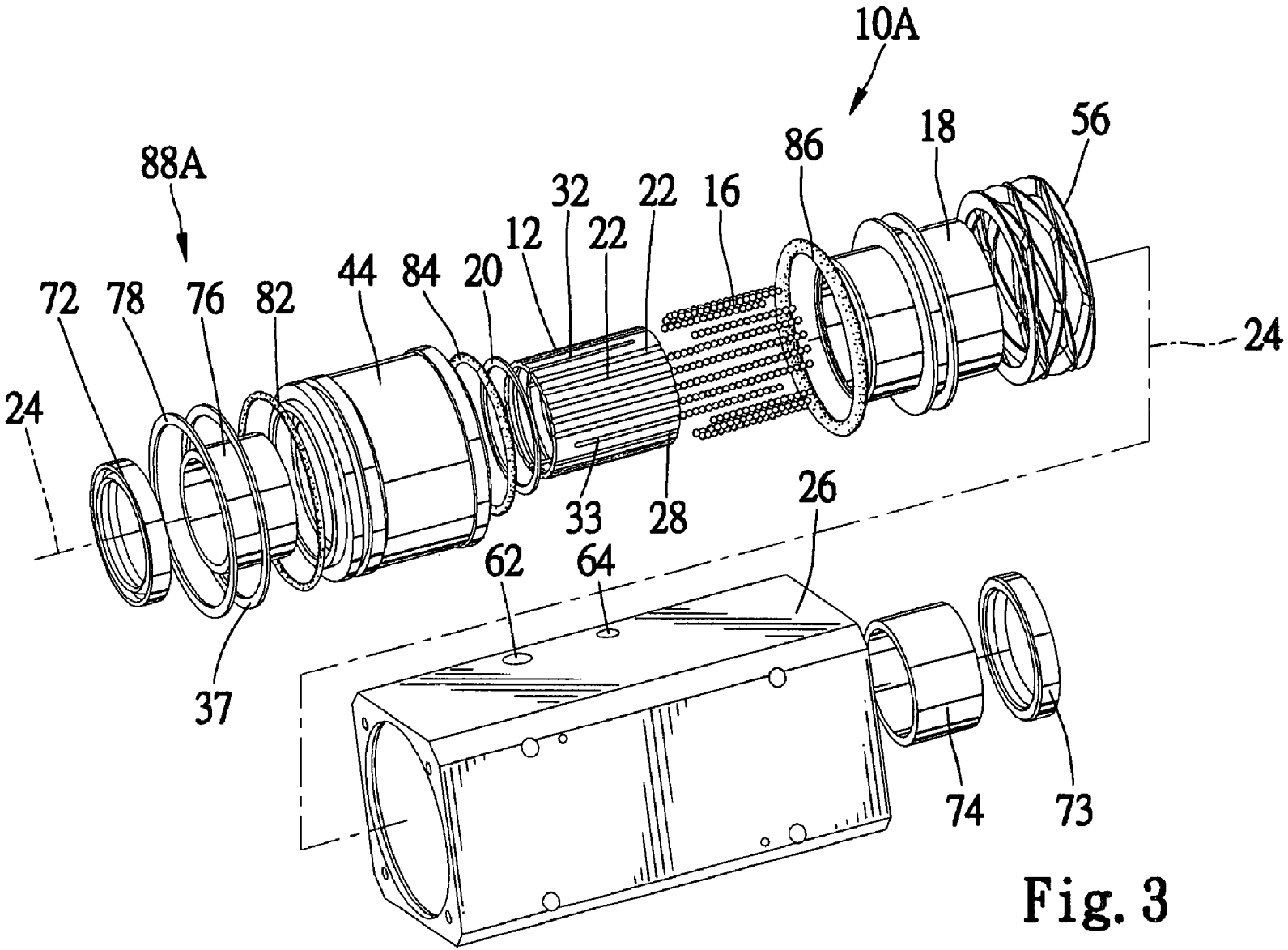
FIG. 3 is an exploded perspective view of the rod motion controller according to the preferred teachings of the present invention shown in FIG. 1.

A rod motion controller according to the preferred teachings of the present invention is shown in FIGS. 1–3 and is generally designated 10A. The rod motion controller 10A uses a backlash reducer 88A to reduce or eliminate backlash in the rod motion controller 10A. A housing 26 provides support for and contains the parts and mechanisms of the rod motion controller 10A. According to the preferred teachings of the present invention, the housing 26 has annular cross sections having an outer periphery that is square with beveled corners. Those skilled in the art will recognize that the cross sections may be any shape that will accommodate the internal parts and mechanisms of the rod motion controller 10A and still accommodate the intended diameter of rod 14. The housing 26 has an inside housing surface 54 forming a hole, or internal passage, to receive the rod 14 there through along the axial direction of axis 24. The rod 14 is shiftable in the axial direction of axis 24.

The housing 26 accommodates the rod 14 which is in slidable contact at various points of an inside housing surface 54 including a first bearing sleeve 74 that is mounted on the inside housing surface 54 and a second bearing sleeve 76 that is mounted on an end cap 44. The rod 14 passes through a hole in the end cap 44, so that, according to the preferred teachings of the present invention, the end cap 44 is configured in the shape of a tube. Other shapes may be employed without deviating from the spirit and scope of the invention. A first rod wiper seal 72 is mounted in the hole of the end cap 44. A second rod wiper seal 73 is mounted on the inside housing surface 54. Both the first rod wiper seal 72 and the second rod wiper seal 73 provide a wiper function as is conventionally known. The first bearing sleeve 74 and the second bearing sleeve 76 provide stability of the rod 14 during both rod retention and rod sliding and provide two axes of restraint. When not engaged or when engaged to slow the rod 14, the rod 14 is free to pass in the axial direction through the housing 26 along the first bearing sleeve 74 and the second bearing sleeve 76. Those skilled in the art will recognize that any means of supporting the rod 14 are within the spirit and scope of the invention.

The end cap 44 and the housing 26 restrain a piston 18 and a friction collar 12. The friction collar 12 and the piston 18 each have a hole, or internal passage, to receive the rod 14 there through along the axial direction of axis 24.

The piston 18 is shaped to fit in the housing 26 and has the hole shaped as a cone on an inside surface 50 to drive balls 16 into the friction collar 12 in response to spring force from a wave spring 56 and in response to fluid pressure in a first chamber 63. The friction collar 12 has an outside surface 28 that has the shape of a cylinder.

The friction collar 12 has a plurality of tracks 22 for the alignment of balls 16 and a first plurality of slits 32 extending in a first direction from a first axial end and spaced from a second axial end and a second plurality of slits 33 extending in a second. direction from the second axial end and spaced from the first axial end.

Suitable provisions are provided to allow the balls 16 to progressively get closer and closer to the center of the friction collar. According to the preferred teachings of the present invention, the shape of the tracks 22 and width of the tracks 22 are designed to widen in either the first direction or second direction to permit the balls 16 to lay closer and closer to the center of the friction collar 12 as they are positioned along the selected direction. This gradual shape change and widening forms a ball ramp that resembles, generally, a conic, because the balls are all of the same diameter, allowing the balls 16 in the widest parts of the tracks 22 to contact the rod 14 first. The second direction opposes the first direction. The first plurality of slits 32 and the second plurality of slits 33 provide ease of deflection of the friction collar 12. The friction collar 12 is designed to engage the rod 14 and to apply an engaging force to the rod 14 in response to force transmitted through balls 16 from the piston 18. The engagement of the rod 14 can be gradual to a full stopping or locking of the rod 14 or the engagement of the rod 14 can be partial, applying only enough force to the rod 14 to slow it, but not stop or lock it. The balls 16 are retained in the tracks 22 in the friction collar 12 in a radial plane extending in the axial direction between the friction collar 12 and the piston 18 and in the axial direction by an adjacent ball 16, by a retaining ring 20 in the inside surface 50 of the piston 18 at one axial end or by a shoulder of the housing 26 against which the friction collar 12 abuts at the other axial end. Since the tracks 22 in the friction collar 12 are linear and align the balls 16 generally along the axial direction, the friction collar 12 deflects in response to a shift in position of the piston 18 due to concerted action by the balls 16. The piston 18, actuated by the wave spring 56 or by fluid pressure in the first chamber 63, drives, in a first engaging direction and then in a second freeing direction, the balls 16 down into the friction collar 12 whereby the friction collar 12 grabs the rod 14, and slows and/or stops it or locks it, or relieves pressure and frees the rod 14, respectively. This operation is helped by the cone shape of the inside surface 50 of the piston 18 cooperating with the cone shape configuration of the balls 16 in the tracks 22 on the outside surface 28 of the friction collar 12. The balls 16 further provide a mechanism to infinitely engage the rod 14 and transmit the force of retention from the piston 18 to the rod 14. The balls 16 accomplish this by allowing the position of the piston 18 to continuously vary in relation to the friction collar 12 by rolling in the tracks 22 as the piston 18 is actuated, and since the inside surface 50 of the piston 18 has the shape of a cone and the outside surface of the balls 16 in the tracks 22 of the friction collar 12 has the shape of a cone, the friction collar 12 gradually, then firmly, engages the rod 14. When the rod motion controller 10A is in the engaged position, the friction collar 12 will backlash by an amount up to the space between the end cap 44 and the internal retaining ring 78, the space between the end cap 44 and the friction collar 12 and the space between the friction collar 12 and the housing 26, thus in turn, allowing the rod 14 to backlash unless restrained by the backlash reducer 88A, 88B or 88C of the present invention.

The backlash reducer 88A according to the preferred teachings of the present invention has a holder in the preferred form of an internal retaining ring 78, a retaining ring groove 37 formed in the inside housing surface 54 of the housing 26, and a backlash reducing shim 36. The end cap 44 is restrained inside the housing 26 by the internal retaining ring 78, which sits in the retaining ring groove 37, and sealed by a first end cap O-ring 82 and a second end cap O-ring 84. The first end cap O-ring 82 seals the end cap 44 to the housing 26. The second end cap O-ring 84 seals the end cap 44 to the piston 18. A piston O-ring 86 seals the piston 18 to the housing 26. The first end cap O-ring 84 cooperates with the second end cap O-ring 84 and the piston O-ring 86 to seal the first chamber 63. In the backlash reducer 88A, between the internal retaining ring 78 and the end cap 44, is placed the backlash reducing shim 36 that takes up substantially all backlash in the mechanism due to specified tolerances. It is this space, the space between the end cap 44 and the internal retaining ring 78 after the friction collar 12 is pressed against the housing 26 and the end cap 44 is pressed against the friction collar 12, which can vary due to manufacturing variances and is the backlash in the rod motion controller 10A. Standard manufacturing tolerances may be responsible for backlash. For example with specified tolerances of 0.005 to 0.02 inches (0.0127 to 0.0508 centimeters), the measured backlash could be in the range of 0.001 to 0.005 inches (0.00254 to 0.0127 centimeters), so that the backlash reducing shim 36 would be sized to provide a separation, or take up a space, between the internal retaining ring 78 and the piston 18 of at least 0.001 to 0.005 inches (0.00254 to 0.0127 centimeters). Those skilled in the art will recognize that any size backlash reducing shim 36, or combination of shims 36, having any prescribed shape that shims the prescribed distance can be used without deviating from the spirit and scope of the invention. According to the preferred teachings of the present invention, the backlash reducing shim 36 is in the shape of a circular ring.

The housing 26 accommodates the wave spring 56 that sits with a first end on a seat 68 formed within the housing 26. The wave spring 56 sits with a second end on a flange 58 of the piston 18, with the piston O-ring 86 located in the flange 58 in the preferred form. When deflected, the wave spring 56 provides a spring force to the piston 18 and the housing 26.

The flange 58 also separates the first chamber 63 from a second chamber 65. To control the position of the piston 18, and thus toggle the state of the rod motion controller 10A from the engaged to the unengaged position, the pressure in the first and second chambers 63 and 65 is controlled. A high enough pressure in the first chamber 63 relative to the second chamber 65 will overcome the force of the wave spring 56 and unengage the rod motion controller 10A by causing the piston 18 to move in an axial direction generally parallel to axis 24 reducing and then eliminating the force on balls 16. The pressure in the first chamber 63 and the second chamber 65 can be controlled in a conventional way by controlling the flow of a fluid, such as air, though ports 62 and 64. If the pressure in the first chamber 63 drops, as would be the case in a fluid supply failure, the wave spring 56 returns the rod motion controller 10A to the engaged state. Thus, the fail-safe condition of the rod motion controller 10A is the engaged state.

Those skilled in the art will recognize that by reversing the roles of the wave spring 56 and the first chamber 63, the fail-safe condition could be the unengaged state. Those skilled in the art will also recognize that the function of the wave spring 56 and high pressure in the first chamber 63 could be performed by a number of devices including a manual actuator, electric actuator, or other fluidic actuator, fluid pressure on both sides of the flange 58, springs on both sides of the flange 58, or any combination of these including any mechanism capable of moving the piston 18 in a controlled way.

The piston 18 slides along and generally parallel to the axis 24 of the rod 14. In the rod motion controller engaged position, when the piston 18 engages in response to force from the wave spring 56 and slides to apply force to the balls 16, the balls 16 drive the friction collar 12 against the rod 14 and, by the resultant friction force, hold the friction collar 12 against the rod 14. Since the friction collar 12 is contained within the housing 26 of the rod motion controller 10A, the housing 26 is held motionless in relation to the rod motion controller 10A. The amount of motion of the friction collar 12, after being allowed to engage, is defined as backlash and is undesirable because the additional motion of the rod 14 may be unwanted.

Those skilled in the art will recognize that any rod 14 that can be inserted in the rod motion controller 10A may be engaged with the rod motion controller 10A as long as the friction collar 12 can actuate to apply a normal force to the surface of the rod 14. By way of example and not limitation, the size of rod 14 to be engaged can accommodate a 1.5 inch (3.81 centimeter) bore.

The balls 16 are sized to fit in the space between the friction collar 12 and the piston 18 without interfering with the free operation of the rod 14. According to the preferred teachings of the present invention, the balls 16 may be constructed from any suitable material or combination of materials, now available or to be developed, useful for transmission of force from the piston 18 without deviating from the spirit and scope of the invention.

Those skilled in the art will recognize that the invention can reduce or eliminate backlash in rod motion controllers 10A having different structures in that the backlash reducer 88A can reduce or eliminate any combination of spaces between rod motion controller elements.

According to the preferred teachings of the present invention, methods are provided to construct the backlash reduced rod motion controller 10A. Accordingly, the processes for construction of the rod motion controller 10A follow in sequence to achieve the desired results of backlash reduction by first installing the friction collar 12, the wave spring 56, the piston 18 and balls 16 that have been previously assembled into the housing 26, and then installing the end cap 44. A force is then applied to the end cap 44 to substantially reduce or eliminate any space between the end cap 44, the friction collar 12 and the housing 26. According to the preferred teachings of the present invention, a space is measured from the end cap 44 to the position of the internal retaining ring 78 and the backlash reducing shim 36 is chosen that is equal to or less than the measured space. The backlash reducing shim 36 is installed and the internal retaining ring 78 is installed so that the backlash reducing shim 36 takes up the space between the internal retaining ring 78 and the end cap 44. The backlash reducing shim 36 takes up the backlash space between the internal retaining ring 78 and the end cap 44 to hold the relative positions of the end cap 44, the friction collar 12, and the housing 26 to substantially reduce or eliminate space between the end cap 44 and the friction collar 12, and between the friction collar 12 and the housing 26.

In operation, the rod motion controller 10A is activated and the piston 18 drives the balls 16 into the friction collar 12, the friction collar 12 holds the rod 14 with friction generated by normal forces with respect to the surface of the rod 14. Opposing elements of the friction collar 12, applying force to the rod 14 equal and opposite to each other, generate the normal forces. The backlash reducer 88A has maintained force on the end cap 44 and holds the end cap 44 against the friction collar 12 and holds the friction collar 12 against the housing 26. Thus, any space that could cause backlash has been reduced or eliminated by the backlash reducer 88A using the backlash reducing shim 36 installed between the end cap 44 and the internal retaining ring 78.

Figure 4:
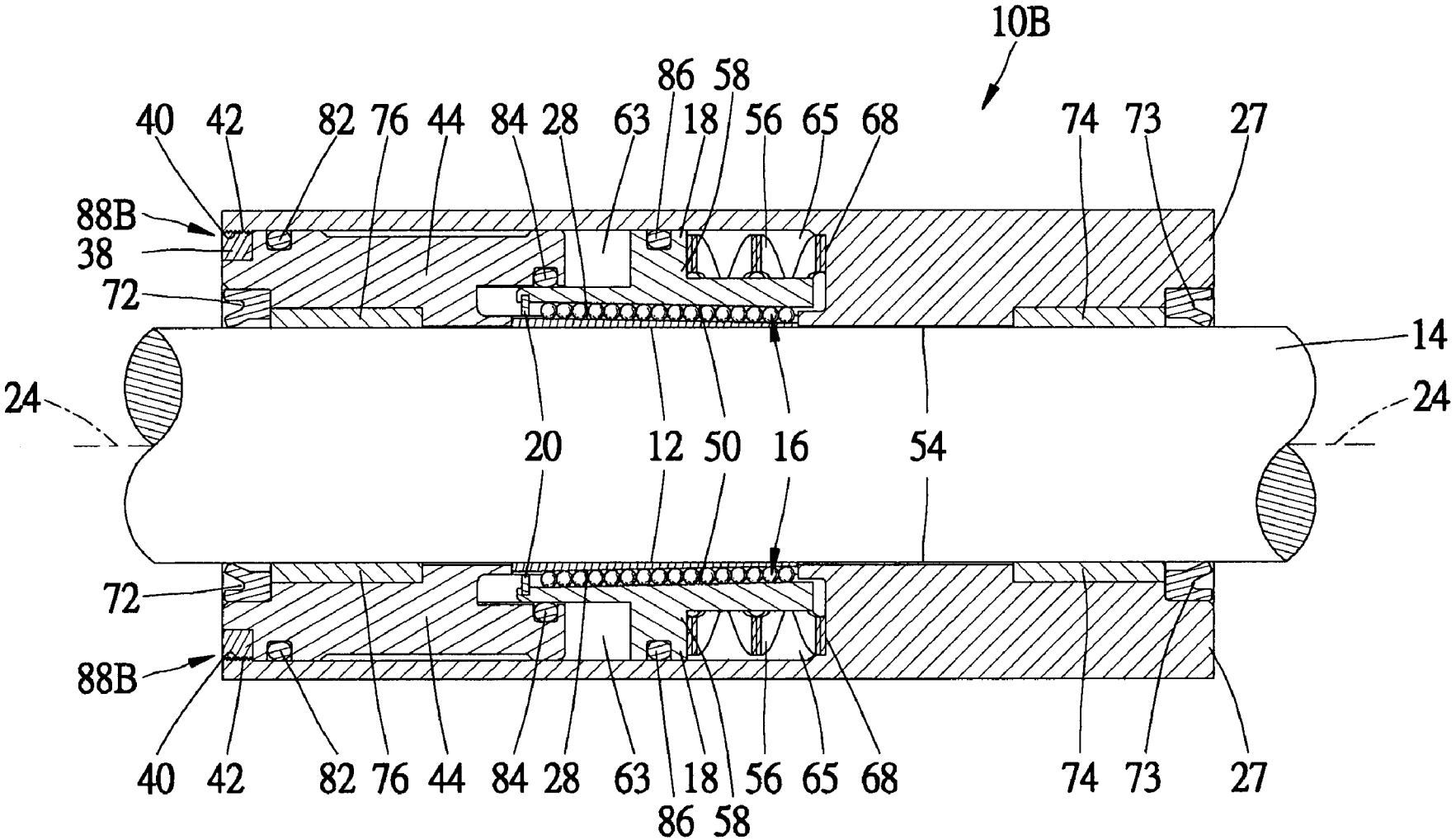
FIG. 4 is a cross sectional view of an alternate embodiment of the rod motion controller according to the preferred teachings of the present invention showing a backlash reducer as a holder with a threaded cap and a threaded inside mount surface.

An alternate form of a rod motion controller according to the preferred teachings of the present invention is shown in FIG. 4 and generally designated 10B. The rod motion controller 10B employs the backlash reducer 88B to reduce backlash in the rod motion controller 10B. The backlash reducer 88B is constructed from a holder in the form of a threaded cap 38 having an outside thread 40 and an inside thread 42 constructed on the inner surface 54 of the housing 27. The threaded cap 38 is used in combination with the inside thread 42 to reduce or eliminate backlash. The threaded cap 38, in combination with the inside thread 42, can be used to reduce or eliminate any space between the end cap 44 and the friction collar 12 and the friction collar 12 and the housing 27 in the axial direction generally parallel to axis 24. The threaded cap 38 has a minimum and maximum adjusting position that can reduce or substantially eliminate the space that causes the backlash. According to the preferred teachings of the present invention, the threaded cap 38 has a ring configuration to allow passage of the rod 14. Those skilled in the art will recognize that the configuration of the threaded cap 38 can vary and any threaded cap 38 that can cooperate with the housing 27 to reduce or substantially eliminate the space that causes the backlash is within the spirit and scope of the invention.

According to the preferred teachings of the present invention, methods are provided to construct the backlash reduced rod motion controller 10B. Accordingly, the processes for construction of the rod motion controller 10B follow in sequence to achieve the desired results of backlash reduction by first installing the friction collar 12, wave spring 56, piston 18 and balls 16 that have been previously assembled into the housing 26, and then installing the end cap 44. A force is then applied to the end cap 44 to eliminate any space between the end cap 44, the friction collar 12 and the housing 27. According to the preferred teachings of the present invention, the threaded cap 38 is screwed into place to hold the end cap 44 firmly in place. Alternatively, the threaded cap 38 is screwed into place until space between the end cap 44, the friction collar 12 and the housing 27 is substantially reduced or eliminated. The outside thread 40 on the threaded cap 38 is screwed into the inside thread 42 to hold the relative positions of the end cap 44, the friction collar 12 and the housing 27 to eliminate space between the end cap 44 and the friction collar 12 and between the friction collar 12 and the housing 27.

In operation, the rod motion controller 10B is activated and the piston 18 drives the balls 16 into the friction collar 12, the friction collar 12 holds the rod 14 with friction generated by normal forces with respect to the surface of the rod 14. Opposing elements of the friction collar 12, applying force to the rod 14 equal and opposite to each other, generate the normal forces. The backlash space has been reduced or eliminated by the correct adjustment of the threaded cap 38.

Figure 5:
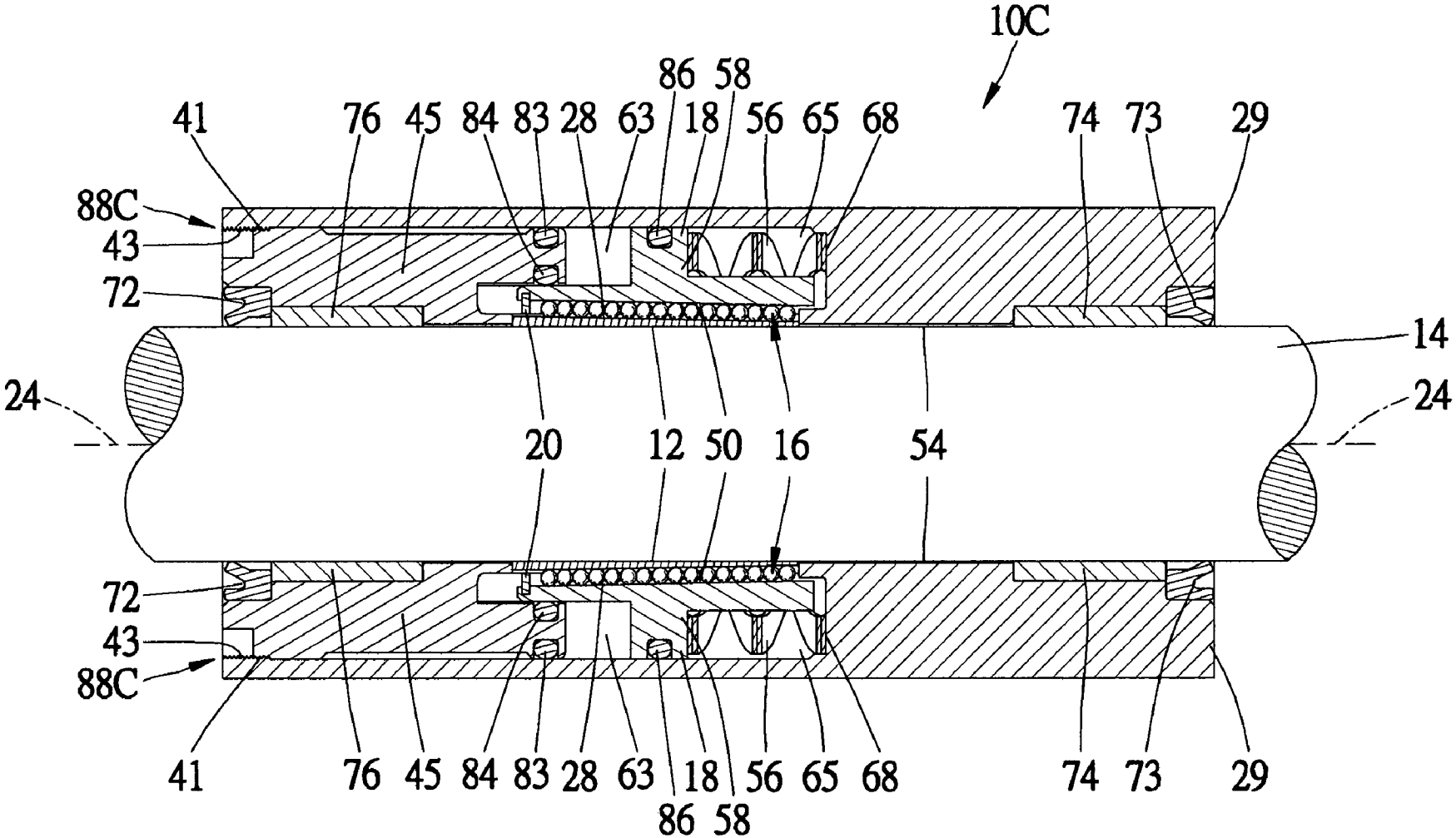
FIG. 5 is a cross sectional view of yet another alternate embodiment of the rod motion controller according to the preferred teachings of the present invention showing a backlash reducer integrally formed as a threaded end cap and a threaded inside mount surface.

A further alternate form of a rod motion controller according to the preferred alternate teachings of the present invention is shown in FIG. 5 and is generally designated 10C. The rod motion controller 10C employs a backlash reducer 88C to reduce backlash in the rod motion controller 10C. The backlash reducer 88C is integrally formed with members that cooperate to restrain relative motion of the friction collar 12. According to the preferred teachings of the present invention, the backlash reducer 88C incorporates an inside thread 43 mating and engaging with an outside thread 41 to reduce or eliminate backlash. The rod motion controller 10C has a housing 29 that has the inside thread 43 created on the part of its inner surface forming one half of the backlash reducer 88C. The end cap 45 has the outside thread 41 created on a part of its outside surface forming the other half of the backlash reducer 88C. The end cap 45 has a minimum and maximum adjusting position that can reduce or substantially eliminate space between the end cap 45 and the friction collar 12 and the friction collar 12 and the housing 29 that causes the backlash. Those skilled in the art will recognize that the exact location of the inside thread 43 and the outside thread 41 can vary along the housing 29 and the end cap 45, respectively, without deviating from the spirit and scope of the invention as long as they can cooperate to reduce or substantially eliminate space between the end cap 45 and the friction collar 12 and the friction collar 12 and the housing 29 that causes the backlash.

The end cap 45 is restrained inside the housing 29 and the housing 29 is sealed by a first end cap O-ring 83 and the second end cap O-ring 84. The first end cap O-ring 83 seals the end cap 45 to the housing 29 and cooperates with the second end cap O-ring 84 and the piston O-ring 86 to seal the first chamber 63. Those skilled in the art will recognize that the location of the various seals such as first end cap O-ring 83 may be positioned in various locations without deviating from the spirit and scope of the invention and that any other position or mechanisms that form a fluid seal may be used.

According to the preferred teachings of the present invention, methods are provided to construct the backlash reduced rod motion controller 10C. Accordingly, the processes for construction of the rod motion controller 10C follow in sequence to achieve the desired results of backlash reduction by first installing the friction collar 12, the wave spring 56, the piston 18 and balls 16 that have been previously assembled into the housing 29, and then installing the end cap 45 by screwing it into the housing 29 to eliminate any space between the end cap 44, the friction collar 12 and the housing 29. The outside thread 41 is screwed into the inside thread 43 to hold the relative positions of the end cap 45, the friction collar 12 and the housing 29 to eliminate space between the end cap 45 and the friction collar 12 and between the friction collar 12 and the housing 29.

In operation, the rod motion controller 10C is activated and the piston 18 drives the balls 16 into the friction collar 12, the friction collar 12 holds the rod 14 with friction generated by normal forces with respect to the surface of the rod 14. Opposing elements of the friction collar 12, applying force to the rod 14 equal and opposite to each other, generate the normal forces. The backlash space has been reduced or eliminated by the correct adjustment of the end cap 45.

Now that the basic teachings of the present invention have been explained, many extensions and variations will be obvious to one having ordinary skill in the art. For example, although various backlash reducers 88A, 88B and 88C have been disclosed and are believed to produce synergistic results, backlash reducers can take other forms according to the teachings of the present invention including but not limited to utilizing one or more retaining rings 78 of the same or differing thicknesses, received in a retaining ring groove 37 arranged in a nonradial direction, or the like.

Those skilled in the art will recognize that any material, or combination of materials, now available or to be developed, capable of transmitting the retaining force to the rod 14 may be used to construct the various parts of the various embodiments of the invention and is within the spirit and scope of the invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

The invention claimed is:

1. Motion control apparatus for use with a rod, with the rod having an axis defining an axial direction, with the rod shiftable in the axial direction, with the apparatus comprising, in combination:

a housing having an inside housing surface forming a hole to receive the rod there through along the axial direction;

a piston mounted in the inside housing surface of the housing that is moveable between a rod motion controller engaged position and a rod motion controller unengaged position;

an end cap slideably mounted on the inside housing surface of the housing to allow motion of the end cap in the axial direction;

a friction collar mounted between and contacting with the housing and the end cap, with an engaging force being generated by the friction collar with the rod when the piston is moved to the rod motion controller engaged position, and when the piston is in the rod motion controller unengaged position, the rod moves in the axial direction; and a backlash reducer reducing relative motion in the axial direction between the friction collar and the housing and between the friction collar and the end cap when the piston is in the rod motion controller engaged position and when the piston is in the rod motion controller unengaged position to reduce backlash in the axial direction when the piston is in the rod motion controller engaged position, with the backlash reducer comprising a holder mounted on the inside housing surface in an adjustable position in the axial direction and abutable with the end cap to reduce backlash by reducing relative motion in the axial direction between the friction collar and the housing and between the friction collar and the end cap, with the holder comprising:

an internal retaining ring mounted on the inside surface of the housing, with the end cap having a first end in contact with the friction collar and a second end held by the internal retaining ring in a backlash reducing position to reduce backlash by reducing relative motion in the axial direction between the friction collar and the housing and between the friction collar and the end cap.

2. The apparatus of claim 1 with the friction collar having a plurality of tracks to support a plurality of balls, with the balls positioned between the plurality of tracks and the piston, and with the friction collar having a plurality of slits in a first direction and a plurality of slits in a second direction, with the first direction opposing the second direction, with the plurality of slits in the first direction and the plurality of slits in the second direction providing ease of deflection of the friction collar, and with the piston positioned to press the balls into the tracks to cause the engaging force to be generated by the friction collar.

3. The apparatus of claim 2 with the piston having a surface in contact with the plurality of balls and with the surface having the shape of a cone to progressively engage the plurality of balls.

4. The apparatus of claim 2 with the piston having a flange and a plurality of seals to create a sealed fluid chamber with the housing, for the containment of a fluid, on one side of the flange, with the sealed fluid chamber having a first fluid port in the housing.

5. The apparatus of claim 4 with the flange having a second side and the housing having a second fluid port for the exhaust of fluid as the rod moves to the rod motion controller engaged position and for the intake of fluid as the piston moves to the rod motion controller engaged position.

6. The apparatus of claim 5 with the piston actuated by a spring, with the spring positioned on the second side of the flange between the housing and the flange of the piston.

7. Motion control apparatus for use with a rod, with the rod having an axis defining an axial direction, with the rod shiftable in the axial direction, with the apparatus comprising, in combination:

a housing having an inside housing surface forming a hole to receive the rod there through along the axial direction;

a piston mounted in the inside housing surface of the housing that is moveable between a rod motion controller engaged position and a rod motion controller unengaged position;

an end cap slideably mounted on the inside housing surface of the housing to allow motion of the end cap in the axial direction;

a friction collar mounted between and contacting with the housing and the end cap, with an engaging force being generated by the friction collar with the rod when the piston is moved to the rod motion controller engaged position, and when the piston is in the rod motion controller unengaged position, the rod moves in the axial direction; and a backlash reducer reducing relative motion in the axial direction between the friction collar and the housing and between the friction collar and the end cap when the piston is in the rod motion controller engaged position and when the piston is in the rod motion controller unengaged position to reduce backlash in the axial direction when the piston is in the rod motion controller engaged position, with the backlash reducer comprising a holder mounted on the inside housing surface in an adjustable position in the axial direction and abutable with the end cap to reduce backlash by reducing relative motion in the axial direction between the friction collar and the housing and between the friction collar and the end cap, with the holder comprising, in combination:

an internal retaining ring mounted on the inside surface of the housing; and a backlash reducing shim, with the end cap having a first end in contact with the friction collar and a second end in contact with the backlash reducing shim, and with the backlash reducing shim positioned intermediate the internal retaining ring and the end cap to reduce backlash by reducing relative motion in the axial direction between the friction collar and the housing and between the friction collar and the end cap.

8. The apparatus of claim 7 with the friction collar having a plurality of tracks to support a plurality of balls, with the balls positioned between the plurality of tracks and the piston, and with the friction collar having a plurality of slits in a first direction and a plurality of slits in a second direction, with the first direction opposing the second direction, with the plurality of slits in the first direction and the plurality of slits in the second direction providing ease of deflection of the friction collar, and with the piston positioned to press the balls into the tracks to cause the engaging force to be generated by the friction collar.

9. Motion control apparatus for use with a rod, with the rod having an axis defining an axial direction, with the rod shiftable in the axial direction, with the apparatus comprising, in combination:

a housing having an inside housing surface forming a hole to receive the rod there through along the axial direction;

a piston mounted in the inside housing surface of the housing that is moveable between a rod motion controller engaged position and a rod motion controller unengaged position;

an end cap slideably mounted on the inside housing surface of the housing to allow motion of the end cap in the axial direction;

a friction collar mounted between and contacting with the housing and the end cap, with an engaging force being generated by the friction collar with the rod when the piston is moved to the rod motion controller engaged position, and when the piston is in the rod motion controller unengaged position, the rod moves in the axial direction; and a backlash reducer reducing relative motion in the axial direction between the friction collar and the housing and between the friction collar and the end cap when the piston is in the rod motion controller engaged position and when the piston is in the rod motion controller unengaged position to reduce backlash in the axial direction when the piston is in the rod motion controller engaged position, with the backlash reducer comprising a holder mounted on the inside housing surface in an adjustable position in the axial direction and abutable with the end cap to reduce backlash by reducing relative motion in the axial direction between the friction collar and the housing and between the friction collar and the end cap, with the friction collar having a plurality of tracks to support a plurality of balls, with the balls positioned between the plurality of tracks and the piston, and with the friction collar having a plurality of slits in a first direction and a plurality of slits in a second direction, with the first direction opposing the second direction, with the plurality of slits in the first direction and the plurality of slits in the second direction providing ease of deflection of the friction collar, and with the piston positioned to press the balls into the tracks to cause the engaging force to be generated by the friction collar.

10. The apparatus of claim 9 with the holder comprising a threaded cap having an outside thread, with the inside surface of the housing having an inside thread, with the outside thread mating with the inside thread to reduce backlash by reducing relative motion in the axial direction between the friction collar and the housing and between the friction collar and the end cap.

11. The apparatus of claim 9 with the piston having a surface in contact with the plurality of balls and with the surface having the shape of a cone to progressively engage the plurality of balls.

12. The apparatus of claim 9 with the piston having a flange and a plurality of seals to create a sealed fluid chamber with the housing, for the containment of a fluid, on one side of the flange, with the sealed fluid chamber having a first fluid port in the housing.

13. The apparatus of claim 12 with the flange having a second side and the housing having a second fluid port for the exhaust of fluid as the rod moves to the rod motion controller engaged position and for the intake of fluid as the piston moves to the rod motion controller engaged position.

14. The apparatus of claim 13 with the piston actuated by a spring, with the spring positioned on the second side of the flange between the housing and the flange of the piston.

15. Method comprising:

providing a housing with an internal passage large enough to accommodate a rod there through;

mounting a friction collar into the housing with the friction collar positioned to selectively hold the rod when the rod is inserted in the internal passage;

mounting an end cap into the housing after the mounting of the friction collar;

applying a force to the end cap after mounting into the housing, with the end cap, the friction collar and the housing being in a relative position to eliminate any space between the end cap and the friction collar and between the friction collar and the housing; and holding the relative position of the end cap, the friction collar and the housing to reduce backlash in operation, with holding the relative position of the end cap, the friction collar and the housing comprising:

installing a holder in the internal passage to abut with the end cap and to hold the end cap, the friction collar and the housing in the relative position, with installing the holder comprising:

installing an internal retaining ring in the internal passage of the housing;

measuring a backlash space from the end cap to the position of the internal retaining ring after applying the force to the end cap to eliminate any space between the end cap and the friction collar and between the friction collar and the housing; and installing a backlash reducing shim intermediate the internal retaining ring and the end cap, with the backlash reducing shim having a width that is equal to or less than the backlash space so that the backlash reducing shim takes up the backlash space between the internal retaining ring and the end cap to hold the relative position of the end cap, the friction collar, and the housing.

* * * * *